United States Patent [19]

Tsuzurahara et al.

[11] 4,044,279

[45] Aug. 23, 1977

[54] MAGNETRONS

[75] Inventors: Mamoru Tsuzurahara; Ichiro Ohara, both of Mobara, Japan

[73] Assignee: Hitachi, Ltd., Tokyo, Japan

[21] Appl. No.: 701,661

[22] Filed: July 1, 1976

[30] Foreign Application Priority Data

July 23, 1975 Japan ..... 50-101337

[51] Int. Cl.[2] ..... H01J 25/50

[52] U.S. Cl. ..... 315/39.51; 315/39.53; 315/39.71; 315/39.75; 219/10.55 D

[58] Field of Search ..... 315/39.51, 39.53, 39.75, 315/39.71; 219/10.55 D

[56] References Cited

U.S. PATENT DOCUMENTS

| | | | |
|---|---|---|---|
| 3,746,916 | 7/1973 | Oguro | 315/39.51 |
| 3,922,612 | 11/1975 | Tashiro | 315/39.51 |
| 3,967,087 | 6/1976 | Kanuma | 315/39.51 |

*Primary Examiner*—Saxfield Chatmon, Jr
*Attorney, Agent, or Firm*—Charles E. Pfund

[57] ABSTRACT

In a magnetron of the type including a metal cylinder extending through a yoke constituting the magnetic circuit for a magnet and disposed in the path of antenna lead wire extending between an anode electrode and an antenna terminal, and a gasket disposed between the yoke and the metal cylinder, there is provided an annular metallic cushion fitted over the metal cylinder. The cushion has an inner diameter slightly smaller than the outer diameter of the cylinder and is provided with a plurality of radial slits on the inner periphery.

5 Claims, 5 Drawing Figures

MAGNETRONS

BACKGROUND OF THE INVENTION

This invention relates to a magnetron, and more particularly to a sealing structure for preventing leakage of electric wave.

Since a magnetron can generate microwaves at high efficiencies it is widely used in radar apparatus and microwave ovens. However, if the connection between a magnetron and such apparatus is not perfect microwaves would leak to the outside thereby decreasing the effective output of the magnetron. Moreover, such leaked wave causes radio frequency interference and emission effect of nearby electric machines and apparatus. If electrical connection is not perfect electric spark occurs.

FIG. 1 of the accompanying drawing shows one example of an inner magnet type magnetron widely used in microwave ovens comprising a yoke 11, a cylindrical anode electrode 12 and a cathode electrode 13 at the center of the anode electrode. A plurality of vanes 14 are secured to the inner surface of the anode electrode to extend toward the cathode electrode. Permanent magnets 15 and 16 are secured to the opposite ends of the anode electrode 12. The magnets are provided with conical pole pieces 17 and 18 respectively for passing magnetic flux through an interaction space defined by the cathode electrode 13 and the vanes 14. Although not shown in the drawing, a stem structure is secured to the pole pieces for supporting the cathode structure 13. The pole piece 17 is sealed to the lower end of a cup shaped metal cylinder 19 extending through the central opening of the annular magnet 15. The metal cylinder 19 projects through the yoke 11 to support a cylindrical insulator 20 which in turn supports an evacuation pipe 21 made of copper, for example, which function as an antenna terminal. One end of an output antenna lead wire 23 connected to one vane 14 is supported by the evacuation pipe 21. The evacuation pipe 21 is covered by a protective metal cap 24 which also functions as an antenna terminal. The metal cylinder 19 functions not only to form a terminal coupled to the antenna terminal but also to shield electric wave radiated from the antenna terminal. An electric discharging tube comprises the anode electrode 12 having a plurality of vanes 14, the cathode electrode 13 with stem structure for supporting it, pole pieces 17 and 18, the metal cylinder 19, the cylindrical insulator 20, the antenna terminal 21 or 24 and the antenna lead wire 23. Therefore, a portion comprised by the metal cylinder 19, the cylindrical insulator 20 and the antenna terminal 21 or 24 constitute an electric wave from the electric discharging tube. A metal cushion in the form of a metal washer 25 is interposed between the magnet 15 and its pole piece 17. Similarly, a metal cushion in the form of a metal washer 26 is interposed between magnet 16 and the yoke 11, and a gasket 27 is interposed between the yoke 11 and the metal cylinder 19. A plurality of cooling fins 28 are secured to the outer periphery of the anode electrode 12.

FIG. 2 is a partial enlarged sectional view showing a manner of preventing the leakage of the microwave energy when the magnetron shown in FIG. 1 is combined with microwave apparatus. In FIG. 2, an annular projection 31 of the wall 30 of a microwave oven or a waveguide is abutted against the gasket 27 made of a metal wire net, for example. Thus, the gasket 27 is clamped between projection 31 and metal washer 26 thereby preventing the microwave energy radiated from the antenna terminal from leaking to the outside. Accordingly, the microwave energy is efficiently transmitted to the waveguide of microwave oven.

However, with the construction described above, although the gasket 27 is strongly urged against the metal washer 26 by the projection 31, when the gasket 27 is heavily deformed by the projection 31 the thickness of the gasket would become non-uniform or shrink. Consequently, a gap is formed between the gasket and the metal cylinder 19 thus breaking the electrical connection therebetween. For the purpose of assuring easy fit between the metal cylinder 19 and the metal washer 26, the inner diameter of the metal washer is generally made to be slightly larger than the outer diameter of the metal cylinder with the result that a gap is formed between the gasket 27 and the metal cylinder 19, a portion of the microwave energy would leak to the outside through such gap. Further, when the electrical connection between the gasket 27 and metal cylinder is not good, an electric spark will strike therebetween in addition to the problem of leakage described above.

SUMMARY OF THE INVENTION

It is an object of this invention to provide a reliable magnetron capable of preventing the leakage of microwave energy as well as sparking at the connection of a magnetron and microwave apparatus, such as a waveguide and a microwave oven.

According to this invention there is provided a magnetron of the class comprising an electric discharging tube comprising a cylindrical anode electrode provided with a plurality of vanes, a cathode electrode and an output portion, said output portion comprising a cup shaped metal cylinder having an opening at a bottom portion thereof, a cylindrical insulator disposed on said bottom portion of said metal cylinder and an antenna terminal disposed on said insulator; a permanent magnet; a yoke having an opening for passing and extending through said metal cylinder; and gasket disposed between said yoke and said metal cylinder characterized in that there is provided an annular metallic cushion having an inner diameter slightly smaller than the outer diameter of the metal cylinder, and a plurality of radial slits or notches on the inner periphery, and that the annular metallic cushion is fitted over the metal cylinder.

DESCRIPTION OF THE PREFERRED EMBODIMENTS

Figure 1:
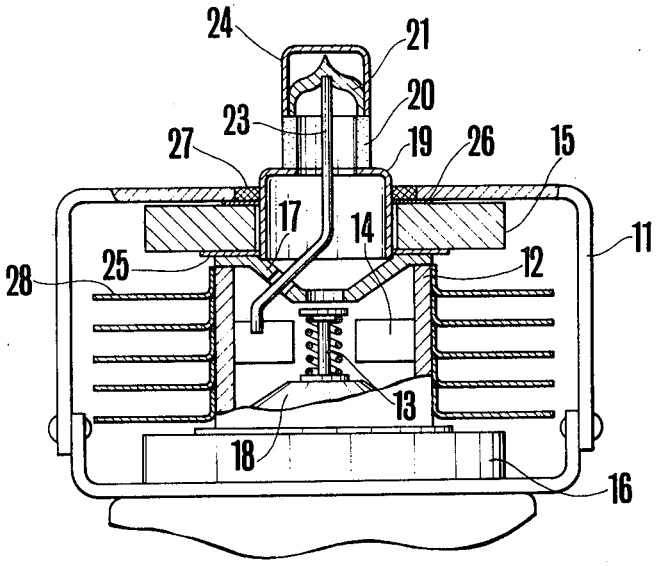
FIG.1 PRIOR ART
FIG. 1 is a longitudinal sectional view showing one example of the prior art magnetron.
Figure 2:
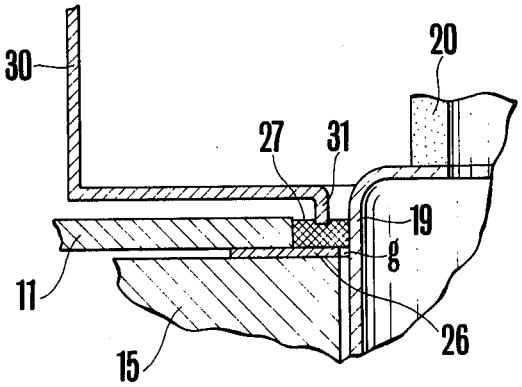
FIG.2 PRIOR ART
FIG. 2 is a partial enlarged sectional view showing the connection between a gasket of the magnetron shown in FIG. 1 and microwave apparatus.
Figure 3:
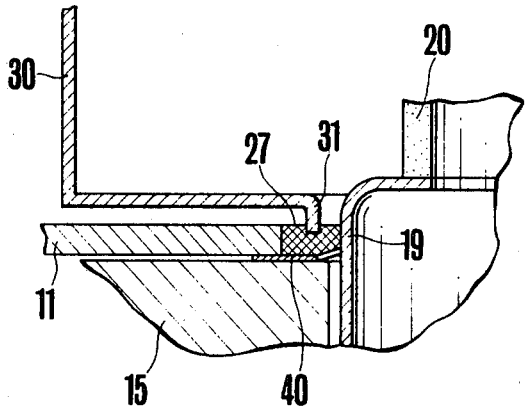
FIG. 3 is a view corresponding to FIG. 2 and showing one example of a magnetron embodying the invention.
Figure 4:
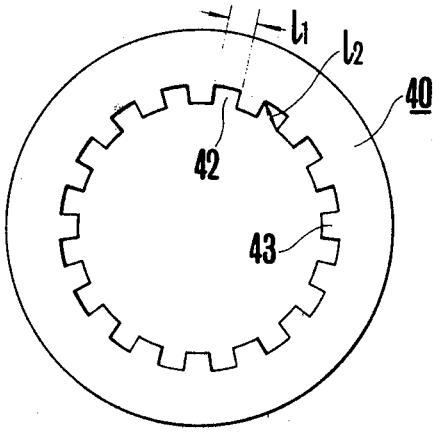
FIG. 4 is a plan view showing a metal washer utilized in the magnetron shown in FIG. 3.

FIG. 3 shows a portion of a magnetron embodying the invention in which portions corresponding to those shown in FIGS. 1 and 2 are designated by the same reference numerals. As shown, an annular metallic cushion or a metal washer 40 embodying the invention is interposed between yoke 11, gasket 27 and magnet 15. The washer 40 is made of such metal as stainless steel, phosphor bronze or magnetic material and has a construction as shown in FIG. 4. The washer has a suitable outer diameter and an inner diameter slightly smaller than the outer diameter of the metal cylinder upon which the washer is to be fitted. A plurality of notches or depressions 42 are formed around the inner periphery of the washer. The shape of each notch is generally square having a width $l_1 = 1.5$ mm and a diagonal length $l_2 = 3$ mm, for example. When the metal cylinder 19 is press-fitted into the metal washer 40, its projections 43 will deflect slightly in the direction opposite to the direction of insertion of the metal cylinder 19 as shown in FIG. 3 thus firmly securing the metal washer to the periphery of the metal cylinder 19. Accordingly, when the projection of the microwave apparatus strongly urges against gasket 27 so as to separate the gasket from the metal cylinder 19 or to break the electrical connection therebetween the metal washer prevents the microwave energy from leaking through the gap as well as electric spark from striking across the gap. Thus it is possible to prevent loss of energy and adverse influence upon nearby electric devices.

When the metal washer 40 is made of stainless steel or phosphor bronze, due to the resiliency of the projections 43, fitting the washer onto the metal cylinder becomes easy. The size and shape of the notches are determined for the purpose of preventing leakage of the microwave energy so that it is not necessary to use any other means to prevent leakage.

Figure 5:
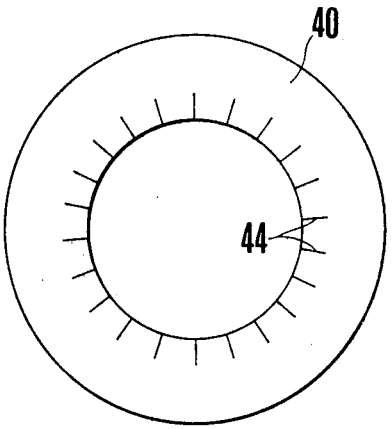
FIG. 5 is a plan view showing a modified metal washer.

It should be understood that the invention is not limited to the specific embodiment described above and that many modifications are possible. For example, the configuration of the notches 42 of the metal washer 40 may be triangular, circular or a simple slit. In a modification shown in FIG. 5, a plurality of radial slits 44 are cut through the inner periphery of a metal washer 44. Such washer can also be fitted on the metal cylinder 19 to accomplish the same object. Thus it is only necessary that the inner diameter of the metal washer is a little smaller than the outer diameter of the metal cylinder 19 and that a plurality of radial slits or notches are formed on the inner periphery of the metal washer.

Although in the foregoing embodiment an inner magnet type magnetron utilizing annular permanent magnets was shown, the invention is also applicable to other type of magnetron, for example an outer magnet type magnetron utilizing bar magnets and a magnet of the type wherein magnets are contained in a sealed tube. Accordingly, it is clear that the invention is applicable to any magnetron including a metal cylinder positioned in a path for leading an antenna to an antenna terminal from an anode electrode and wherein a gasket is arranged between a yoke through which the metal cylinder extends and the metal cylinder.

What is claimed is:

1. In a magnetron of the class comprising an electric discharging tube comprising a cylindrical anode electrode provided with a plurality of vanes, a cathode electrode and an output portion, said output portion comprising a cup shaped metal cylinder having an opening at a bottom portion thereof, a cylindrical insulator disposed on said bottom portion of said metal cylinder and an antenna terminal disposed on said insulator; a permanent magnet; a yoke having an opening for passing and extending through said metal cylinder; and a gasket disposed between said yoke and said metal cylinder, the improvement which comprises an annular metallic cushion having an internal diameter slightly smaller than the outer diameter of said metal cylinder, and a plurality of radial slits or notches on the inner periphery, said annular metallic cushion being fitted over said metal cylinder.

2. The magnetron according to claim 1 wherein said slits or notches are shaped to prevent leakage of the microwave energy radiated from said antenna.

3. The magnetron according to claim 1 wherein said notches are square and equally spaced around the inner periphery of said metallic cushion.

4. The magnetron according to claim 1 wherein said metallic cushion is made of a sheet of metal.

5. The magnetron according to claim 1 wherein said magnet is annular, said metallic cushion is interposed between said annular magnet and said yoke below said gasket, and the lower end of said metal cylinder is secured to the hole piece connected to one end of said anode electrode.

* * * * *